United States Patent [19]

Suzuki et al.

[11] 4,177,114

[45] Dec. 4, 1979

[54] SILVER-ELECTROPLATING PROCESS

[75] Inventors: Yoshihiro Suzuki; Mitsuru Ura, both of Hitachi; Hiroshi Takahashi, Higashi Ibaraki, all of Japan

[73] Assignee: Hitachi, Ltd., Japan

[21] Appl. No.: 937,803

[22] Filed: Aug. 29, 1978

[30] Foreign Application Priority Data

Sep. 2, 1977 [JP] Japan ..... 52-104888

[51] Int. Cl.[2] ..... C25D 5/34

[52] U.S. Cl. ..... 204/38 B; 106/1.26; 204/43 R; 204/46 R

[58] Field of Search ..... 204/38 B, 46 R, 43 R; 106/1.13, 1.19, 1.26

[56] References Cited

U.S. PATENT DOCUMENTS 3,362,895 1/1968 Foulke ..... 204/43 R 3,984,290 10/1976 Kitaey et al. ..... 204/30

FOREIGN PATENT DOCUMENTS 2704553 8/1977 Fed. Rep. of Germany ..... 204/46 R

*Primary Examiner*—G. L. Kaplan

*Attorney, Agent, or Firm*—Craig and Antonelli

[57] ABSTRACT

A process for silver-plating, which comprises steps of preplating a substrate material in an aqueous preplating solution comprising $10^{-5}$ to 0.02 mole/l of silver and more than 0.01 mole/l of a silver complexing agent such as thiocyanic ions under non-current density, to preplate a sufficient thickness of silver to restrain or substantially prevent substitution plating, and then electroplating the preplated substrate material until a sufficient thickness by supplying an electric current to said material in an aqueous silver plating solution comprising silver ions, thiocyanic ions and a film improving agent.

18 Claims, No Drawings

SILVER-ELECTROPLATING PROCESS

The present invention relates to a process of silver electroplating and more particularly to a process of electroplating comprising electroplating steps, and aqueous solution being employed in the process.

Almost all of the silver plating solutions so far in practice contain cyan ions, that is, the solutions contain the so-called cyanides as the main component. Plating films having very good elongation and luster can be formed from such plating solutions. However, as is well known, the cyan ions have a strong toxicity, and thus such plating solutions have many problems in, maintenance of a safe working atmosphere, treatment of waste effluent solution, etc. Thus, development of a silver plating solution containing no cyan ions has been keenly desired up to now.

Regarding cyanide-free aqueous baths for electrodepositing silver coatings, it has been proposed, as described in Japanese Published patent application No. 50-120,435 and U.S. Pat. No. 3,984,292 to Culjkovič, to employ a cyanide-free aqueous bath for electrodeposition of silver containing silver and a thiosulfate, and as described in *Metal Finishing* by L. Domnikov, 64, [4], 57 (1966), page 58, left column at line 20 to right column at line 16 to employ a cyanide-free aqueous for electrodeposition of silver containing silver, thiocyanate ions and surface active compounds.

These baths have been carefully tested and compared, and it has been found that all the plating films obtained from these baths have considerably poorer properties than those of the plating films obtained from the bath containing cyan ions. That is, the former plating films have such disadvantages as poor luster, fragile plating, dendritic surfaces or rugged surfaces, or lacking in smoothness, etc., and thus have not been utilized on an industrial scale. Furthermore, when a metallic substrate is other than silver, there is such a common disadvantage that an adhesiveness between the substrate and the plated film is poor. One of the inventors of the present application have already proposed, in application Ser. No. 911,077 filed May 31, 1978, an electroplating method using an aqueous solution containing thiocyanic ions in an amount of 0.5 to 10 moles/l, silver ions in an amount of 0.04 to 0.8 mole/l and a film improving agent in an amount effective to suppress a local growth of a silver film on a metallic substrate to be plated, which comprises subjecting, prior to the electroplating, the metallic substrate to a preplating step under a current density of 0.1 to 80 mA/dm$^2$ in an aqueous solution containing silver ions in an amount of 0.001 to 0.02 mole/l and thiocyanic ions in an amount of 0.1 to 5 moles/l, whereby the adhesiveness of the resulting electroplated silver film to the substrate is improved.

SUMMARY OF THE INVENTION

It is therefore an object of the invention to improve the adhesiveness of an electroplated silver film to a metallic substrate as well as to improve the quality of the electroplated film.

Another object of the present invention is to provide either a process of silver electro-plating or an aqueous solution for the process which is capable of forming an electroplated silver film having a high toughness, an excellent appearance and good throwing power.

Another object of the present invention is to provide a process of silver electroplating using an aqueous solution containing non-toxic ingredients.

Another object of the present invention is to provide either a process of silver electroplating or an aqueous solution for the process which can improve the adhesiveness of electroplated silver film to a metallic substrate, even though a cathode current density is zero upon preplating of silver to the metallic substrate.

Another object of the present invention is to provide a process of a silver preplating which can extend the range of a usable concentration of silver in a preplating aqueous solution.

One aspect of the invention provides a process for silver-plating, which comprises steps of preplating a substrate material in an aqueous preplating solution comprising $10^{-5}$ to 0.02 mole/l of silver and more than 0.01 mole/l, i.e. 0.01 to 5 mole/l of a silver complexing agent under non-current density, to preplate a sufficient thickness of silver to restrain or substantially prevent substitution plating, (i.e. from 200 Å to 5000 Å) and then electroplating the preplated substrate material by supplying an electric current to said material in an aqueous silver plating solution which contains a film-improving agent. The term "non-current density" is meant to define a situation where no electrical current is applied to the solution to induce deposition.

Another aspect of the invention provides a cyanide-free aqueous bath for electrodeposition of silver containing silver and thiocyanic ions, which comprises an aqueous solution containing thiocyanic ions in amount from 0.5 to 10 moles/l, silver ions in an amount of 0.04 to 0.8 mole/l and at least one additive, i.e. a film improving agent, selected from the group consisting of:

| | |
|---|---|
| Bromine ions ($Br^-$) | $1 \times 10^{-3}$ to 0.1 mole/l |
| Iodine ions ($I^-$) | $1.2 \times 10^{-4}$ to $1.2 \times 10^{-3}$ mole/l |
| Selenocyanic ions ($SeCN^-$) | $5 \times 10^{-4}$ to $1 \times 10^{-2}$ mole/l |
| Cobalt ions ($Co^{++}$) | $5 \times 10^{-6}$ to $5 \times 10^{-3}$ mole/l |
| Stannic acid ions ($SnO_3^{--}$) | $1 \times 10^{-4}$ to $1 \times 10^{-2}$ mole/l |
| Thiourea ($SC(NH_2)_2$) | $5 \times 10^{-6}$ to $5 \times 10^{-3}$ mole/l |
| Triethanol amine ($(HOCH_2CH_2)_3N$) | $1 \times 10^{-3}$ to 1 mole/l |
| Selennic acid ions ($SeO_4^{--}$) | $5 \times 10^{-6}$ to $5 \times 10^{-3}$ mole/l |

The aqueous preplating solution is preferably used by containing at least a silver complexing agent in an amount of more than 0.01 mole/l, selected from the group consisting of ammonia, thiosulfate ions, bromine ions, iodine ions, methylamine, thiourea, dimethylamine, ethylamine, ethylenamine, ethylenediamine, glycine, 2-hydroxy ethyleneamine, imidazole, allylamine, n-propylamine, 2-2'-diamino diethylamine, 2-2'-diamino diethylsulfide, histidine, phenylthioacetic acid, benzylthioacetic acid, β-benzylthiopropionic acid and thiocyanic ions.

The present invention is preferably applied to silver plating of metallic substrates such as copper, nickel, or their alloys. Substrates may be composite material or laminates comprising a metallic film of copper, nickel or their alloys, and an insulating body.

When the metallic substrate is a pure noble metal, a good adhesion is obtained between the substrate and the resulting plating film, but in other cases, i.e. with copper, nickel or their alloys, the adhesiveness is sometimes poor. When a thick silver plating film is formed, the resulting plating film is sometimes peeled off during the plating, if the adhesiveness is poor. As a means for enhancing the adhesiveness, a preplating is applied in the present process. When a more readily ionizable metal than silver is placed in the present silver plating solution, the metal is dissolved into the silver plating solution, while silver is deposited instead. That is, the so-called substitution plating takes place. The silver plating film formed by the substitution plating usually has a low mechanical strength. On the contrary, according to this invention in which a substitution plating is carried out as a preplating, a high mechanical strength, especially a strong adhesiveness can be obtained.

DESCRIPTION OF THE PREFERRED EMBODIMENTS

In the present invention, the preplating is carried out in a solution having the low concentration of silver ions at non-current density to deposit a thin silver film. The conventional strike plating is carried out at a high current density, whereas the present process is carried out characteristically at non-current density. The plating solution for the preplating has a silver ion concentration of $10^{-5}$ to 0.02 mole/l and thiocyanic ions of more than 0.01 mole/l. A film-improving agent as explained later may be contained in the solution for the preplating. The preplating may be carried out at non-current density at room temperature for a period of about 10 seconds to about 30 minutes. The plating film to be formed by the preplating must have a thickness large enough to restrain or substantially prevent any occurrence of the substitution plating, that is, usually a thickness of at least several hundred Å, i.e. from 200 Å to 5000 Å.

After the preplating step, mentioned above, an electroplating of the metallic substrate is carried out in an aqueous solution containing silver ions of 0.04 to 0.8 mole/l, thiocyanic ions of 0.5 to 10 moles/l and a film improving agent. Substitution plating does not easily occur in a case wherein the concentration of silver in an aqueous solution is lowered and thus restraining or substantially preventing silver deposition on the substrate material. The silver deposition is restrained or prevented by presenting an amount of silver complexing agent in the aqueous solution, because the silver ions in the aqueous solution reacts with the complexing agent to form a stable silver complex compounds.

The substitution plating is that which occurs when a metal having a higher ionization tendency than silver has been put into the aqueous solution. The metal is dissolved in the aqueous solution to discharge electrons in the aqueous solution, resulting in silver plating on the substrate material by using the electrons. A silver film formed by employing substitution plating does not have a high adhesiveness on the substrate material. As a result of a development by inventors for restraining the substitution plating, a silver film having a high adhesiveness was made by lowering the deposition speed of silver on the substrate material in the preplating process. The deposition speed of silver is adjusted by adding a silver complexing agent into the aqueous solution.

For the purpose of controlling the deposition speed of silver, silver complexing agents having the stability constant being within a range of $1\times10^{6}$ to $1\times10^{15}$ at a temperature of 25° C. can be preferably used. It is desirable to increase a concentration of such complexing agents. Practically it is recommendable to add at least a silver complexing agent in an amount of more than 0.01 mole/l in the aqueous solution and less than the dissolving limits.

The stability constant is defined by K explained in the following equation.

Where metallic ions in an aqueous solution are defined by M and a complexing agent reacting with the metal ions M is defined by L, and at the same time a chemical reaction formula is as follows:

$$mM+nL=MmLn$$

wherein m and n are integers, the stability constant K is represented by the following equation:

$$K=\frac{[Mm\,Ln]}{[M]^{m}\,[L]^{n}}$$

Since the stability constant is well known in this art, a detailed explanation is not needed. (See "Stability Constants of Metal-Iron Complexes" by G. Sillen and A. E. Martell, Chemical Society, London 1964).

Further it is recommended that silver is within a concentration of $10^{-5}$ to $2\times10^{-2}$ mole/l in the aqueous solution.

When a substrate material having an ionization tendency higher than silver is submerged into the aqueous solution, a silver film is progressively formed by plating of silver on the substrate material under non-current density. When some thickness of silver film is obtained, the substitution plating is restrained and at last prevented, because the silver film covers substantially all of surface of the substrate material. Such a thin silver film, formed in an aqueous solution containing silver in a low concentration and an amount of silver complexing agent through the substitution plating, has a strong adhesiveness.

Ammonia has a capacity to form complex compounds of silver, and thus it is preferable to use ammonia to control pH of the present plating solution or add ammonium thiocyanate as an electrolyte in place of alkali thiocyanate. Especially, a silver plating film having a good luster can be obtained from the present plating solution having a pH elevated by the addition of ammonia.

Following compounds are employable as suitable silver complexing agents: ammonia, thiosulfate ions, bromine ions, iodine ions, methylamine, thiourea, dimethylamine, ethylamine, ethylenamine, ethylenediamine, glycine, 2-hydroxy ethyleneamine, imidazole, allylamine, n-propylamine, 22'-diamino diethylamine, 2,2'-diamino diethylsulfide, histidine, phenylthioacetic acid, benzylthioacetic acid and β-benzylthiopropionic acid. These compounds have a stability constant of $1\times10^{6}$ to $1\times10^{15}$ at a temperature of 25° C. and are usable alone or in mixture.

The deposition speed of silver of 0.001 mg/dm$^2$ to 0.01 mg/dm$^2$ per second is recommended in order to obtain a thin silver film having a strong adhesiveness.

After the thin silver film having a strong adhesiveness has been formed on the substrate material, a thick silver electro-plating is practiced. At the time, an addition of a film-improving agent into an aqueous silver plating solution is recommended.

When said film-improving agent is added to the plating solution containing thiocyanic ions and silver ions, a stable complex of silver ions or sparingly soluble silver compounds are formed in the plating solution. Thus, silver deposition overvoltage is increased, as the film improving agents, the complex ions or the sparingly soluble silver compounds are absorbed selectively at the active locations on a cathode, and consequently silver deposition on its locations are suppressed. That is, it seems that flatness of the plating film is ensured thereby, and consequently luster and mechanical properties of the plating film are improved.

In carrying out the present invention, practical composition of the silver plating solution is in the following range:

| | |
|---|---|
| Silver ions ($Ag^+$) | 0.04 to 0.8 mole/l |
| Thiocyanic ions ($SCN^-$) | 0.5 to 10 moles/l |

Silver ions are generated from dissolved silver compounds such as AgCl, AgBr, AgI, AgSCN, $Ag_2O$, $Ag_2CO_3$, $Ag_2SO_4$, $AgNO_3$, $Ag_2SeO_4$ or $AgCH_3COO$. Thiocyanic ions are obtained by dissolving thiocyanic compounds such as KSCN, NaSCN, $NH_4SCN$, CsSCN, or RbSCN. When AgSCN is used as a source of silver ions, a concentration of thiocyanic ions is determined by taking into consideration a concentration of AgSCN.

As the film-improving agent the following ions or compounds are preferably used.

| | |
|---|---|
| Bromine ions ($Br^-$) | $1 \times 10^{-3}$ to $1 \times 10^{-1}$ mole/l |
| Iodine ions ($I^-$) | $1.2 \times 10^{-4}$ to $1.2 \times 10^{-3}$ mole/l |
| Selenocyanic ions ($SeCN^-$) | $5 \times 10^{-4}$ to $1 \times 10^{-2}$ mole/l |
| Selenic acid ions ($SeO_4^{--}$) | $5 \times 10^{-6}$ to $5 \times 10^{-3}$ mole/l |
| Cobalt ions ($Co^{++}$) | $5 \times 10^{-6}$ to $5 \times 10^{-3}$ mole/l |
| Stannic acid ions ($SnO_3^{--}$) | $1 \times 10^{-4}$ to $1 \times 10^{-2}$ mole/l |
| Thiourea ($SC(NH_2)_2$) | $5 \times 10^{-6}$ to $5 \times 10^{-3}$ mole/l |
| Triethanol amine ($(HOCH_2CH_2)_3N$) | $1 \times 10^{-3}$ to 1 mole/l |

Film improving ions or compounds are obtained by dissolving KSeCN, NaSeCN, KBr, NaBr, KI, NaI, AgI, RbI, CsI, $H_2SeO_4$, $Ag_2SeO_4$, $K_2SeO_4$, $Na_2SeO_4$, $CoSeO_4$, $CoSO_4$, $CoCl_2$, $CoSeO_4$, $Na_2SnO_3$, $SC(NH_2)_2$, or $(HOCH_2CH_2)_3N$ in an electroplating solution. The film improving agents are used singly or in combination.

When such compounds as AgI or $Ag_2SeO_4$ are used, the concentration of silver ions in the electroplating solution is determined by taking into consideration the amount of a film improving agent used. When such compounds as $CoSeO_4$ are used, both $Co^{++}$ and $SeO_4^{--}$ function as film improving agents or ions in the solution.

The ranges for the film improving agents as described above have been determined by experiments, and if the amount of the film-improving agents is less than the lower limits of the ranges, the resulting silver plating films have a poor luster and unsatisfactory mechanical properties. When the amount exceeds the upper limits of the ranges, the grains in the plating films become coarse, and the plating films become brittle.

The improvement of the toughness of the silver plating films is most remarkable when iodine ions are added to the solution, and is decreased in the order of selenocyanic ions to bromine ions, but the differences in the improvement among these agents are not so large. However, the improvement of the throwing power is far greater when selenocyanic ions is added to the solution than when other agents are added thereto. Therefore, an addition of a mixture of bromine or iodine ions with selenocyanic acid to the solution can greatly improve both the properties of the resulting silver plating films and the throwing power.

The pH range of the plating solution to be used in the present invention is 0.5 to 10.5, which is broader than the pH range of more than 10 in the conventional silver cyanide bath. When the plating solution is in an acidic zone of less than pH 0.5, the luster of the resulting plating film is deteriorated, losing the effect of the addition of the film-improving agent. On the other hand, when pH is higher than 10.5, black silver compounds are suspended in the plating solution, and tone of the resulting plating film becomes blackish. However, if the plating is carried out only for a short time even at pH of about 11, the plating solution is deteriorated.

The optimum pH range for the present plating solution is 3 to 9. When ammonia is contained in the present plating solution, a preferable condition is obtained for forming the plating film at pH of 8 to 11, as heretofore described.

The breadth of the allowable pH range for the plating solution offers not only such an advantage that the bath can be easily controlled, but also another advantage that impurities contaminating the plating solution can be precipitated by adjusting the pH to the desired value, and removed by filtration, and the resulting filtrate can be used immediately as the plating solution. Furthermore, there is a solder layer or an insulating material, as attached to a material to be plated, and if the solder layer or the insulating material is readily attacked by the plating solution, a pH range wherein the solution sparingly attacks the solder layer or the insulating material can be selected to carry out the plating. This is another advantage of the present plating solution.

As materials to be plated, nickel, copper, and their alloys can be used. Surfaces of these substrate metals are thoroughly cleaned in the manner as usually practised by those skilled in the art, and then the plating is carried out by connecting the cleaned substrate metals to a cathode.

Electroplating is carried out by stirring the plating solution or by keeping the plating solution in a flowing state at a cathode current density of 0.5 to 10 A/dm$^2$ and a bath temperature of room temperature to 80° C., using silver as an anode. The electric source may be a DC current or AC current-superposed DC current. Of course, either a constant voltage source or a constant current source can be used.

Besides the plating in the ordinary plating tank, the so-called local plating method can be carried out by making the plating solution flow along parts of the material to be plated or by providing the plating solution soaked in a sponge or the like on the parts of the material to be plated, and plating films can be thereby formed, because the present plating solution is hardly toxic.

The present invention will be described in detail by referring to the following Examples.

Procedures for determining various properties of plating films shown in the Examples are described below.

Tensile strength and elongation: Resulting silver plating film is peeled off from a substrate metal, and a rectangular test piece having an available tension part of 8 mm wide and 40 mm long is prepared therefrom, and measured by an Universal micro-tension tester made by Toyo Sokki K.K., Japan. Values given therein are an average of five measurements.

Luster: A luster is visually observed or a white light beam is irradiated onto a plating film, the light reflected on the plating film is received in a photo-electric tube, and a luster is determined from relations between an angle of light source-plating film-light receiver (scattered angle: $\theta$) and an intensity of reflected light.

Adhesiveness: A silver plating film having a thickness of 12 μm is formed on a copper plate having a thickness of 6 mm, a width of 12 mm, and a length of 100 mm, and the resulting plate is used as a test piece. The side of the plated plate to be tested is placed on two fulcra having a distance of 60 mm, and a bar having a radius of curvature of 3.5 R at its tip is pressed against the back side of the plated plate at a center between the fulcra. State of crack development and state of peeling of the plating film on the plated side are observed. Pressing speed is 5 mm/min. Adhesiveness is classified into 5 grades, whose standards are given in Table 1.

Thickness of plating film: measured according to procedure for electrolytic measurement of thickness (JIS H 8618) and microscopic measurement of cross-section.

Appearance: White light is irradiated onto the plating film, and the film is visually observed.

Table 1

| Grade of adhesiveness | State of plating film |
|---|---|
| 1 | No cracks are developed. |
| 2 | Slight cracks are developed at edge parts. |
| 3 | Small cracks are developed at both edge parts and center part. |
| 4 | Large cracks are developed at both edge parts and center part. |
| 5 | Plating film is peeled off. |

Throwing power: A copper disk having a diameter of 50 mm is placed in parallel with an anode, and section thicknesses of silver plating film at center part a and location b 5 mm distant from circumference at the back side of the disk, that is, the side not facing the anode, are microscopially measured, and a throwing power is evaluated by a ratio of film thickness of b/a.

Overall judgement: Overall judgement is made in view of plating workability and properties of the resulting film. Standards for the judgement are given in Table 2.

Table 2

| Overall judgement | Mode |
|---|---|
| A | Very good |
| B | Good |
| C | Poor |
| D | Very poor |

In the following Examples 1 to 4 are concerned with effects of film improving agents. The electro-plating in these examples were carried out with preplating (according to the conditions of No. 25 in Table 7) except Comparatives. By combining the preplating and the plating steps, excellent silver films were obtained.

EXAMPLE 1

Zero to 0.5 mole/l of silver bromide were added to aqueous solutions, each, containing 0.1 mole/l of silver thiocyanate and 3 moles/l of potassium thiocyanate, and pH of the solutions were adjusted to ranges of 6.5 to 7, using a dilute aqueous solution of potassium hydroxide and a dilute aqueous solution of sulfuric acid.

Three liters of the pH-adjusted plating solutions were placed in respective thermostat plating tanks, and samples were plated, using a silver plate as an anode at an interelectrode distance of 100 mm and a plating bath temperature of 30°±2° C., while blowing air into the tanks at a rate of 3 l/min. for stirring the plating solutions.

The samples were stainless steel plates having a size of 50 mm×60 mm, having one side copper plated to a thickness of 0.5 μm with a copper pyrophosphate plating solution, and the other side completely coated with an epoxy resin film.

The samples were connected to a cathode of a DC constant current power source, and the plating was carried out for 10 minutes at a cathode current density of 1.7 A/dm$^2$. The theoretical plating thickness calculated from the quantity of electricity was then 10.8 μm.

Appearance, plating film thickness, tensile strength and elongation of the resulting silver plating films were measured, and overall judgements as the plating solution were made. The results are shown in Table 3.

Table 3

| No. | Concentration of film-improving agent (AgBr) (mole/l) | Tensile strength (kg/mm$^2$) | Elongation (%) | Film thickness (μm) | Appearance | Overall judgement |
|---|---|---|---|---|---|---|
| Comparative 1 | 0 | — | — | about 10 | Milk white, lusterless | D |
| Comparative 2 | $1 \times 10^{-4}$ | about 8 | about 0.5 | 10.2 | Milk white, lusterless | D |
| 1 | $1 \times 10^{-3}$ | 15 | 1.2 | 10.6 | Silver White, lustrous | B |
| 2 | $1 \times 10^{-2}$ | 19 | 1.8 | 10.5 | Silver white, lustrous | A |
| 3 | $4 \times 10^{-2}$ | 19 | 2.1 | " | Silver White, lustrous | A |
| 4 | $1 \times 10^{-1}$ | 17 | 1.7 | 10.1 | Silver White, lustrous | A |
| Comparative 3 | $5 \times 10^{-1}$ | 12 | 1.1 | 10.7 | Silver White, partly lustrous, uneven in surface | C |

From the plating solution containing no AgBr as the film-improving agent was deposited a milk white, brittle plating film, on the surface of which cracks were developed when a thin piece for tensile test was prepared, and its tensile strength could not be measured. At the AgBr concentration of about $2\times10^{-2}$ mol/l, the plating films had a maximum tensile strength and maximum elongation. The tensile strength and elongation were lowered again at the AgBr concentration of above $10^{-1}$ mole/l. The tensile strength and elongation at the AgBr concentration of $5\times10^{-1}$ mole/l were almost identical with those at the AgBr concentration of $10^{-3}$ mole/l, but the resulting plating film readily had an uneven surface, and the plating solution was overall-judged as C.

For comparison, another silver plating film was formed from a standard plating solution of silver cyanide system so far widely used, and its properties were measured. Tensile strength was 18 to 22 kg/mm$^2$, elongation 2%, and appearance was silver white and lustrous. Its overall judgement was marked "A". That is, the conventional plating film had similar properties to those of the present invention. (The standard plating solution contains 0.30 mole/l AgCN, 1.15 mole/l KCN and 0.11 mole/l $K_2CO_3$).

EXAMPLE 2

Test results based on iodine as the film-improving agent are given in Table 4, where compositions of the plating solutions used, properties of the resulting silver plating films and overall judgements as the plating solution are shown.

Table 4

| No. | Composition of plating solution (mole/l) | | pH | Tensile strength (kg/mm$^2$) | Elongation (%) | A Appearance | Overall judgement |
|---|---|---|---|---|---|---|---|
| Comparative 4 | AgSCN 0.5-KSCN 3-AgI | 0 | 6.5 | — | — | Milk white, lusterless, uneven in surface | D |
| Comparative 5 | " | $5\times10^{-5}$ | " | — | — | Milk white, lusterless | D |
| 5 | " | $2\times10^{-4}$ | " | 22 | 2.2 | Silver white, lustrous | A |
| 6 | " | $8\times10^{-4}$ | " | " | 2.3 | Silver white, lustrous | A |
| 7 | " | $1.2\times10^{-3}$ | " | " | 2.1 | Silver white, lustrous | A |
| Comparative 6 | " | $2\times10^{-3}$ | " | 20 | 2.0 | Silver white, lustrous, uneven in surface | C |
| Comparative 7 | AgSCN 0.3-$NH_4SCN$4-KI | 0 | " | — | — | Milk white, lusterless | D |
| 8 | " | $3\times10^{-4}$ | " | 19 | 1.8 | Silver white, lustrous, even in surface | A |
| 9 | AgSCN 0.3-$NH_4SCN$4-KI | $1\times10^{-3}$ | " | 22 | 2.3 | Silver white, lustrous, even in surface | A |
| Comparative 8 | AgSCN 0.2-KSCN 2-RbI | $4\times10^{-4}$ | 0.3 | 13 | 0.8 | Silver white, somewhat poor in luster | C |
| 10 | " | " | 1 | 20 | 1.9 | Silver white, lustrous | A |
| 11 | " | " | 4 | " | 2.0 | Silver white, lustrous | A |
| 12 | " | " | 8 | 21 | 1.9 | Silver white, lustrous | A |
| 13 | " | " | 10 | 20 | " | Silver white, lustrous | A |
| Comparative 9 | " | " | 11.5 | 16 | 1.3 | Blackish, lustrous, uneven in periphery | C |
| 14 | AgSCN 0.06-$NH_4SCN$4-CsI | $5\times10^{-4}$ | 6.5 | 18 | 1.8 | Silver white, lustrous | A |
| 15 | " | $1\times10^{-3}$ | " | 19 | " | Silver white, lustrous | A |

Similar effects of improvement were obtained with potassium iodide, rubidinum iodide and cesium iodide as the film-improving agents to be added, in place of silver iodide.

EXAMPLE 3

Results of tests using silver selenocyanate as the film-improving agent are given in Table 5, where $1\times10_{-5}$ to $1\times10^{-1}$ mole/l of silver selenocyanate were added to plating solutions, each, containing 0.2 mole/l of silver thiocyanate and 3 moles/l of potassium thiocyanate, and silver plating films were formed in the same manner as in Example 1.

Table 5

| No. | Concentration of AgSeCN as film improving agent (mole/l) | Tensile strength (kg/mm$^2$) | Elongation (%) | Appearance | Overall judgement |
|---|---|---|---|---|---|
| Comparative 10 | $1\times10^{-5}$ | — | — | Milk white, lusterless | D |
| 16 | $5\times10^{-4}$ | 16.7 | 1.8 | Silver white, lustrous, somewhat uneven in surface | B |
| 17 | $1\times10^{-3}$ | 18.0 | 1.9 | Silver white, lustrous | A |

Table 5-continued

| No. | Concentration of AgSeCN as film improving agent (mole/l) | Tensile strength (kg/mm$^2$) | Elongation (%) | Appearance | Overall judge-ment |
|---|---|---|---|---|---|
| 18 | $1 \times 10^{-2}$ | 17.5 | 1.9 | Silver white, lustrous | A |
| Comparative 11 | $1 \times 10^{-1}$ | 15.1 | 1.6 | Silver white, lustrous, uneven in surface | C |

EXAMPLE 4

Plating solutions were prepared by adding potassium bromide, potassium iodide, potassium selenocyanate and a mixture of potassium iodide and potassium selenocyanate to plating solutions, each, containing 0.2 mole/l of silver thiocyanate and 3 moles/l of potassium thiocyanate.

One side each of copper disks having a diameter of 50 mm was coated with a paint of rubber system, and the exposed side of the copper disks was plated for 30 minutes in the respective plating solutions, by placing the exposed side, that is, the side to be deposited, of the copper disk away from an anode, that is, by making the coated side face the anode. Thicknesses of the resulting plating film were measured at the center part a of the disks and at the position b 5 mm distant from the periphery to indicate the throwing power in terms of b/a. The results are given in Table 6.

Table 6

| No. | Concentration of film-improving agent (mole/l) | Throwing power (b/a) | Appearance | Overall judge-ment |
|---|---|---|---|---|
| 19 | KBr $5 \times 10^{-2}$ | 1.5 | Round projections developed at periphery | B |
| 20 | KI $5 \times 10^{-4}$ | 1.5 | Round projections developed at periphery | B |
| 21 | KSeCN $5 \times 10^{-3}$ | 1.3 | Smooth projections developed at periphery | A |
| 22 | KI $5 \times 10^{-4}$-KSeCN $5 \times 10^{-3}$ | 1.2 | Smooth | A |

Addition of the mixture of iodide and selenocyanate has a great effect of improving the throwing power.

EXAMPLE 5

Effect of preplating upon adhesiveness is shown in the instant Example.

Surfaces of copper plates having a thickness of 6 mm, width of 12 mm and length of 100 mm were polished smooth by Emery abrasive paper and buffing, then defatted in acetone, and washed with water, and then the copper plates were subjected to preplating. Silver plating films were formed to a thickness of 12 82 m, using plating solutions containing 0.2 mole/l of silver thiocyanate, 3 moles/l of potassium thiocyanate, and film-improving agent. The resulting plating films were deformed on a bending testing machine, and the adhesiveness of the films was evaluated in view of the states of crack development on the plating films. The bending angles of less than 60° were obtained by forcedly bending the plate outside the testing machine. Conditions for preplating, film-improving agents used in the silver plating, and results of the bending tests are given in Table 7.

Table 7

| No. | Preparing solution (mole/l) AgSCN | KSCN | Br$^-$, I$^-$, or SeCN$^-$ | Current density (mA/dm$^2$) | Time (min.) | Silver plating film-improving agent (mole/l) | Bending test (α) 135° | 90° | 45° | 20° |
|---|---|---|---|---|---|---|---|---|---|---|
| 23 | $1 \times 10^{-5}$ | 0.8 | 0 | 0 | 30 | Br$^-$ $1 \times 10^{-2}$ | 1 | 1 | 2 | 2 |
| 24 | $1 \times 10^{-4}$ | " | 0 | " | 20 | " | 1 | 1 | 1 | 2 |
| 25 | $1 \times 10^{-3}$ | " | 0 | " | 5 | " | 1 | 1 | 1 | 1 |
| 26 | " | " | 0 | " | 3 | " | 1 | 1 | 2 | 2 |
| 27 | $1 \times 10^{-2}$ | " | 0 | " | 5 | " | 1 | 1 | 1 | 2 |
| Comparative 12 | $5 \times 10^{-2}$ | " | 0 | " | " | " | 1 | 1 | 2 | 3 |
| Comparative 13 | — | — | — | " | — | " | 2 | 3 | 5 | 5 |
| 28 | $1 \times 10^{-3}$ | 0.01 | Br$^-$ $1 \times 10^{-2}$ | 0 | 3 | " | 1 | 1 | 2 | 2 |
| 29 | " | 0.1 | " | " | 5 | " | 1 | 1 | 1 | 2 |
| 30 | " | 1 | " | " | 3 | " | 1 | 1 | 2 | 2 |
| 31 | " | 5 | " | " | 3 | " | 1 | 1 | 2 | 2 |
| 32 | " | 1.5 | I$^-$ $2 \times 10^{-4}$ | " | 5 | I$^-$ $2 \times 10^{-4}$ | 1 | 1 | 1 | 2 |
| 33 | " | " | " | " | " | " | 1 | 1 | 1 | 2 |
| 34 | " | " | " | " | " | " | 1 | 1 | 1 | 2 |
| 35 | " | " | " | " | " | " | 1 | 1 | 2 | 2 |
| Comparative 14 | $1 \times 10^{-3}$ | 1.5 | I$^-$ $2 \times 10^{-4}$ | 0 | 5 | I$^-$ $2 \times 10^{-4}$ | 1 | 2 | 2 | 3 |
| 36 | $1 \times 10^{-3}$ | 1.5 | 0 | " | 5 | SeCN$^-$ $5 \times 10^{-4}$ | 1 | 1 | 2 | 3 |
| 37 | " | " | SeCN$^-$ $5 \times 10^{-4}$ | " | " | " | 1 | 1 | 1 | 2 |

As is apparent from the results shown in Table 7, the preplating solutions contain $10^{-5}$ to 0.02 mole/l of silver thiocyanate and more than 0.01 mole/l of thiocyanic ion as essential components, and the plates were treated in the preplating solutions at non-current density. Test piece No. Comparative 13 was the one directly subjected to the silver plating without any preplating, and small cracks developed at edges and center part at the bending angle of 90°.

When a silver plating film obtained from the conventional silver cyanide solution was subjected to the same bending test as above, the grades judged were 1 to 2 when bent to 20°. Thus, the adhesiveness was almost equal to that of the plating film obtained according to the present invention.

It will be appreciated from the foregoing description that the alloys of copper and nickel used as substrates include alloys containing copper, nickel and some other metallic ingredients; alloys containing nickel without copper and some other metallic ingredients and alloys containing copper without nickel and some other metallic ingredients. Moreover, the advantages achieved by the present invention include:

(1) No requirement of supplementary facilities such as an electrical source for preplating;

(2) high efficiency on the preplating operation, because of no requirement of electrical leads; and (3) greater convenience for treating a number of small parts for preplating at the same time.

What is claimed is:

1. A process for silver-plating which comprises the steps of preplating a substrate material in an aqueous preplating solution comprising $10^{-5}$ to 0.02 mole/l of silver and more than 0.01 mole/l of a silver complexing agent under non-current density, to preplate a sufficient thickness of silver to restrain or substantially prevent substitution plating, and then electroplating the preplated substrate material by supplying an electric current to said material in an aqueous silver plating solution comprising silver and thiocyanic ions and having a pH in a range of from 0.5 to 10.5.

2. A process according to claim 1, wherein the silver is in the electroplating aqueous silver plating solution in a concentration of 0.04 to 0.8 mole/l.

3. A process according to claim 2, wherein the electroplating aqueous silver plating solution is made by dissolving AgCl, AgBr, AgI, AgSCN, $Ag_2O$, $Ag_2CO_3$, $Ag_2SO_4$, $AgNO_3$, AgSCN, $Ag_2SeO_4$, or $AgCH_3COO_3$ in an aqueous medium.

4. A process according to claim 1, wherein the thiocyanic ions are in the electroplating aqueous silver plating solution in a concentration of 0.5 to 10 moles/l.

5. A process according to claim 4, wherein the thiocyanic ions are generated from dissolved KSCN, NaSCN, $NH_4SCN$, CsSCN, or RbSCN.

6. A process according to claim 1, wheren the electroplating aqueous silver plating solution contains a film-improving agent in an amount sufficient to suppress a local growth of silver deposition.

7. A process according to claim 6, wherein the film-improving agent is at least one member selected from the group consisting of:

| | |
|---|---|
| Bromine ions ($Br^-$) | $1 \times 10^{-3}$ to 0.1 mole/l |
| Iodine ions ($I^-$) | $1.2 \times 10^{-4}$ to $1.2 \times 10^{-3}$ mole/l |
| Selenocyanic ions ($SeCN^-$) | $5 \times 10^{-4}$ to $1 \times 10^{-2}$ mole/l |
| Cobalt ions ($Co^{++}$) | $5 \times 10^{-6}$ to $5 \times 10^{-3}$ mole/l |
| Stannic acid ions ($SnO_3^{--}$) | $1 \times 10^{-4}$ to $1 \times 10^{-2}$ mole/l |
| Thiourea ($SC(NH_2)_2$) | $5 \times 10^{-6}$ $5 \times 10^{-3}$ mole/l |
| Triethanol amine ($(HOCH_2CH_2)_3N$) | $1 \times 10^{-3}$ to 1 mole/l |
| Silinic acid ions ($SeO_4^{--}$) | $5 \times 10^{-6}$ to $5 \times 10^{-3}$ mole/l |

8. A process according to claim 7, wherein the bromine ions are generated from dissolved AgBr, KBr, or NaBr.

9. A process according to claim 7, wherein the iodine ions are generated from dissolved KI, NaI, AgI, RbI, or CsI.

10. A process according to claim 7, wherein the selenocyanic ions are generated from dissolved $H_2SeO_4$, $Ag_2SeO_4$, $K_2SeO_4$ or $Na_2SeO_4$.

11. A process according to claim 7, wherein the selenic acid ions are generated from dissolved $H_2SeO_4$, $Ag_2SeO_4$, $K_2SeO_4$ or $Na_2SeO_4$.

12. A process according to claim 7, wherein the cobalt ions are generated from dissolved $CoSO_4$, $CoCl_2$ or $CoSeO_4$.

13. A process according to claim 7, wherein the stannic acid ions ($SnO_3^{--}$) are generated from dissolved $Na_2SnO_3$.

14. A process according to claim 1, wherein the substrate material is copper, nickel or their alloys.

15. A process according to claim 1, wherein the silver complexing agent has a stability constant of $1 \times 10^6$ to $1 \times 10^{15}$ at 25° C. with relation to silver in the aqueous preplating solution.

16. A process according to claim 1, wherein the silver complexing agent is selected from the group consisting of thiocyanic ions, ammonia, thiosulfate ions, bromine ions, iodine ions, methylamine, thiourea, dimethylamine, ethylamine, ethyleneamine, glycine, 2-hydroxy ethyleneamine, imidazole, allylamine, n-propylamine, 2,2'-diamino diethylamine, 2,2'-diamino diethylsulfide, histidine, phenylthioacetic acid, benzylthioacetic acid and $\beta$-benzylthiopropionic acid.

17. A process according to claim 1, wherein the preplating is carried out for a period of about 10 seconds to about 30 minutes.

18. A process according to claim 1, wherein the deposition speed of silver during the preplating is within 0.001 mg/dm$^2$ to 0.01 mg/dm$^2$ per second.

* * * * *